US009819078B2

(12) United States Patent
Kim et al.

(10) Patent No.: US 9,819,078 B2
(45) Date of Patent: Nov. 14, 2017

(54) ANTENNA APPARATUS

(71) Applicant: LG INNOTEK CO., LTD., Seoul (KR)

(72) Inventors: Jong Guk Kim, Seoul (KR); Jeong Hoon Cho, Seoul (KR); Ja Kwon Ku, Seoul (KR); Kyung Suk Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 74 days.

(21) Appl. No.: 14/416,974

(22) PCT Filed: Jul. 23, 2013

(86) PCT No.: PCT/KR2013/006601

§ 371 (c)(1),
(2) Date: Jan. 23, 2015

(87) PCT Pub. No.: WO2014/017813

PCT Pub. Date: Jan. 30, 2014

(65) Prior Publication Data

US 2015/0207222 A1 Jul. 23, 2015

(30) Foreign Application Priority Data

Jul. 23, 2012 (KR) ..... 10-2012-0079875

(51) Int. Cl.
*H01Q 1/52* (2006.01)
*H01Q 5/371* (2015.01)
(Continued)

(52) U.S. Cl.
CPC ..... *H01Q 1/523* (2013.01); *H01Q 1/243* (2013.01); *H01Q 1/38* (2013.01); *H01Q 5/371* (2015.01); *H01Q 9/0414* (2013.01); *H01Q 1/521* (2013.01)

(58) Field of Classification Search
USPC ..... 343/841, 700 MS, 702
See application file for complete search history.

(56) References Cited

U.S. PATENT DOCUMENTS 4,131,893 A * 12/1978 Munson ..... H01Q 1/27 343/700 MS
4,827,271 A 5/1989 Berneking et al.
(Continued)

FOREIGN PATENT DOCUMENTS

CN 1462493 A 12/2003
EP 1933418 A1 6/2008
(Continued)

OTHER PUBLICATIONS

International Search Report in International Application No. PCT/KR2013/006601, filed Jul. 23, 2013.
(Continued)

*Primary Examiner* — Jessica Han
*Assistant Examiner* — Hai Tran
(74) *Attorney, Agent, or Firm* — Saliwanchik, Lloyd & Eisenschenk

(57) ABSTRACT

Disclosed is an antenna apparatus. The antenna apparatus includes a lower antenna element; an upper antenna element on the lower antenna element; and an intermediate ground element interposed between the lower antenna element and the upper antenna element and overlapping with the lower antenna element and the upper antenna element. The antenna apparatus may have an expanded resonance frequency band.

13 Claims, 7 Drawing Sheets

(51) Int. Cl.

| | |
|---|---|
| ***H01Q 1/24*** | (2006.01) |
| ***H01Q 1/38*** | (2006.01) |
| ***H01Q 9/04*** | (2006.01) |

(56) References Cited

U.S. PATENT DOCUMENTS

| | | | | |
|---|---|---|---|---|
| 6,545,572 | B1 * | 4/2003 | Ohta | H01P 5/028 333/246 |
| 7,696,931 | B2 * | 4/2010 | Kim | H01Q 1/243 343/700 MS |
| 2009/0135077 | A1 | 5/2009 | Kim et al. | |
| 2010/0090907 | A1 | 4/2010 | Ko et al. | |
| 2011/0102289 | A1 | 5/2011 | Leem | |
| 2011/0241960 | A1 | 10/2011 | Lu et al. | |
| 2011/0248890 | A1 | 10/2011 | Lee et al. | |
| 2012/0026043 | A1 | 2/2012 | Rida et al. | |
| 2012/0256804 | A1 | 10/2012 | Ban et al. | |

FOREIGN PATENT DOCUMENTS

| | | | |
|---|---|---|---|
| FR | 2825837 | A1 | 12/2002 |
| FR | 2958458 | A1 | 10/2011 |
| JP | 3656470 | B2 | 6/2005 |
| JP | 2012-0444653 | A | 3/2012 |
| KR | 10-2008-0029678 | A | 4/2008 |
| KR | 10-2011-0049544 | A | 5/2011 |
| KR | 10-1119354 | B1 | 3/2012 |
| WO | WO-2006/049382 | A1 | 5/2006 |
| WO | WO-2011/076075 | A1 | 6/2011 |

OTHER PUBLICATIONS

European Search Report in European Application No. 13822556.0, filed May 27, 2015.

Office Action dated Jun. 3, 2016 in Chinese Application No. 201380049496.5.

* cited by examiner

[FIG.1]
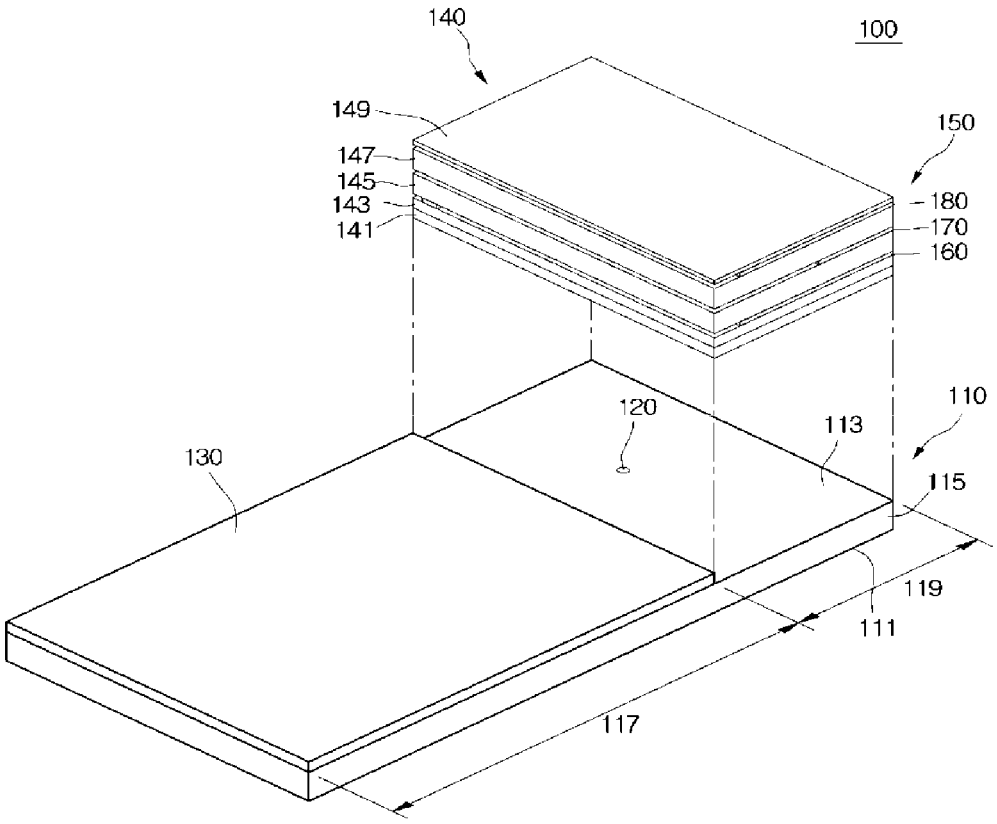

[FIG.2]
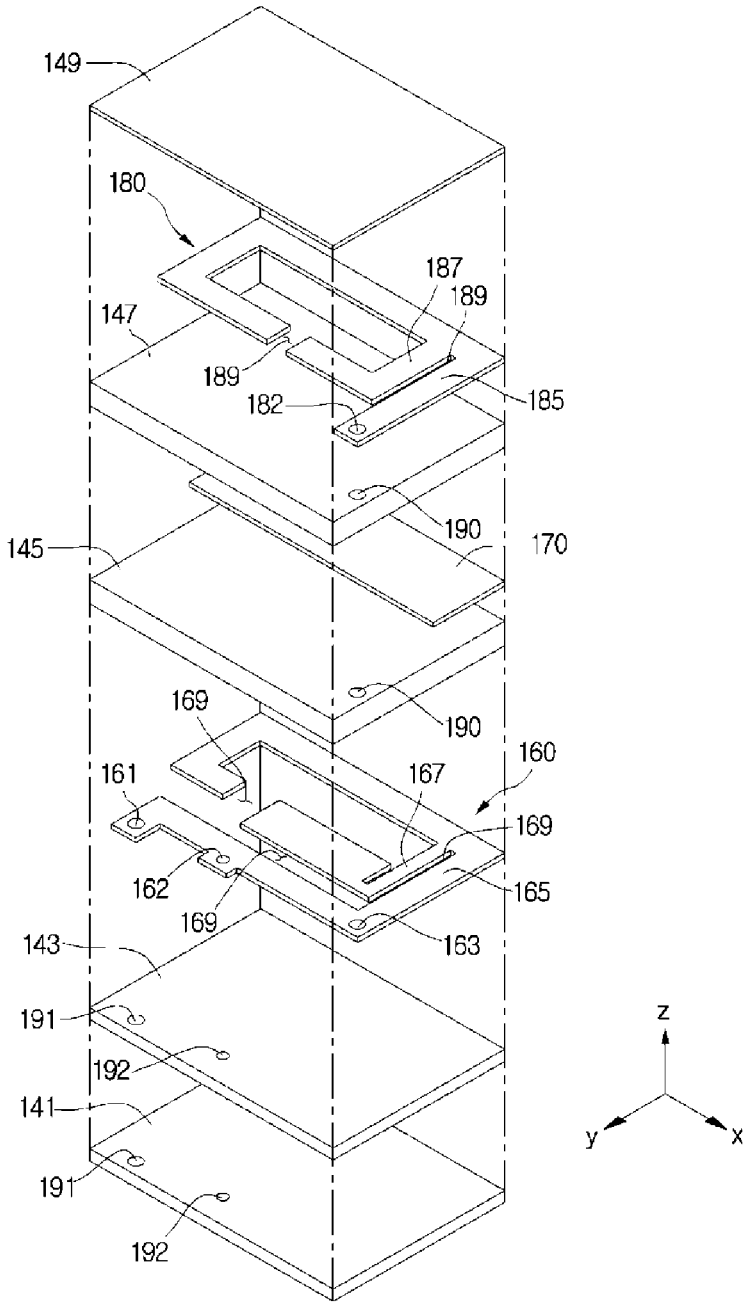

[FIG.3]
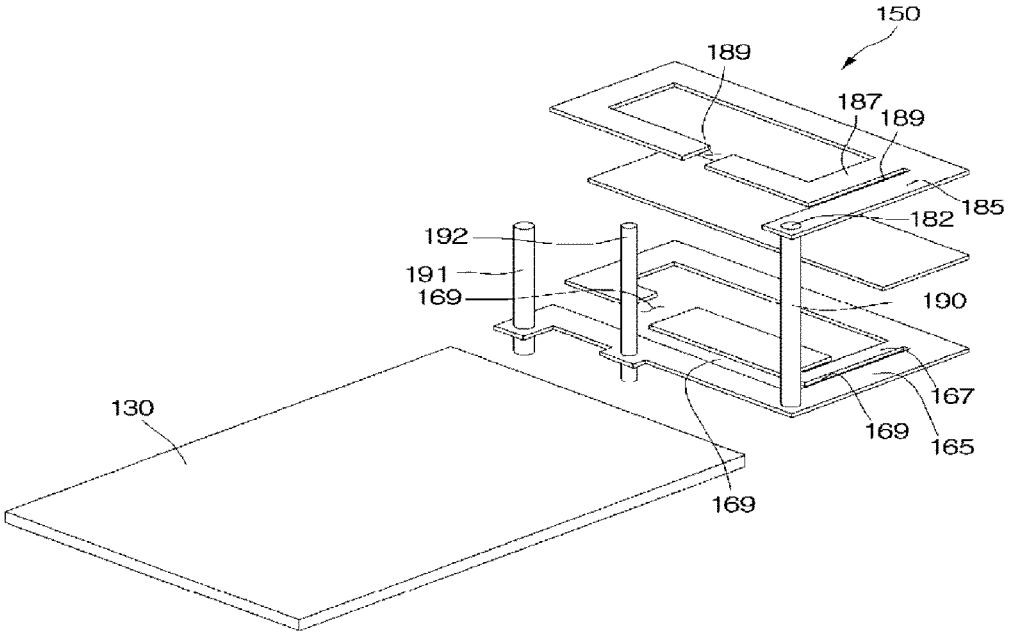
[FIG.4]
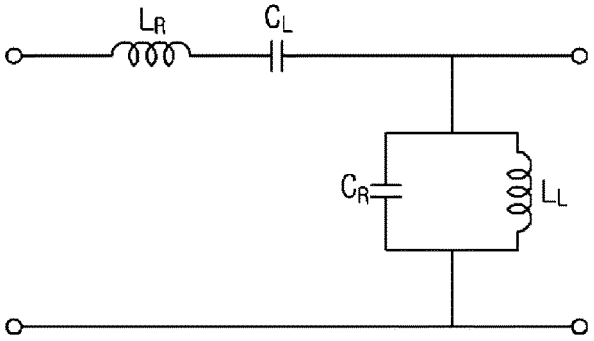

[FIG.5]
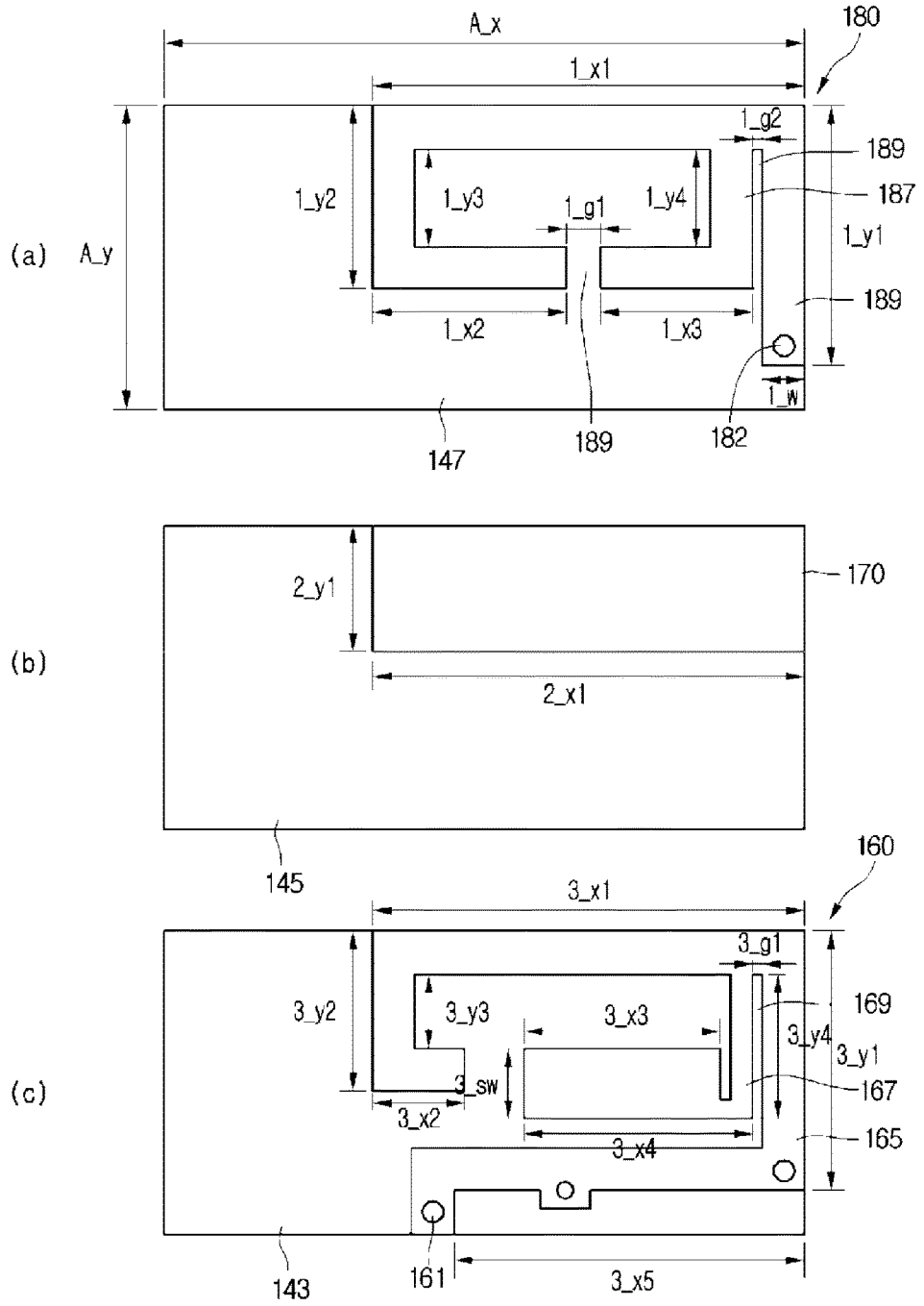

[FIG.6]
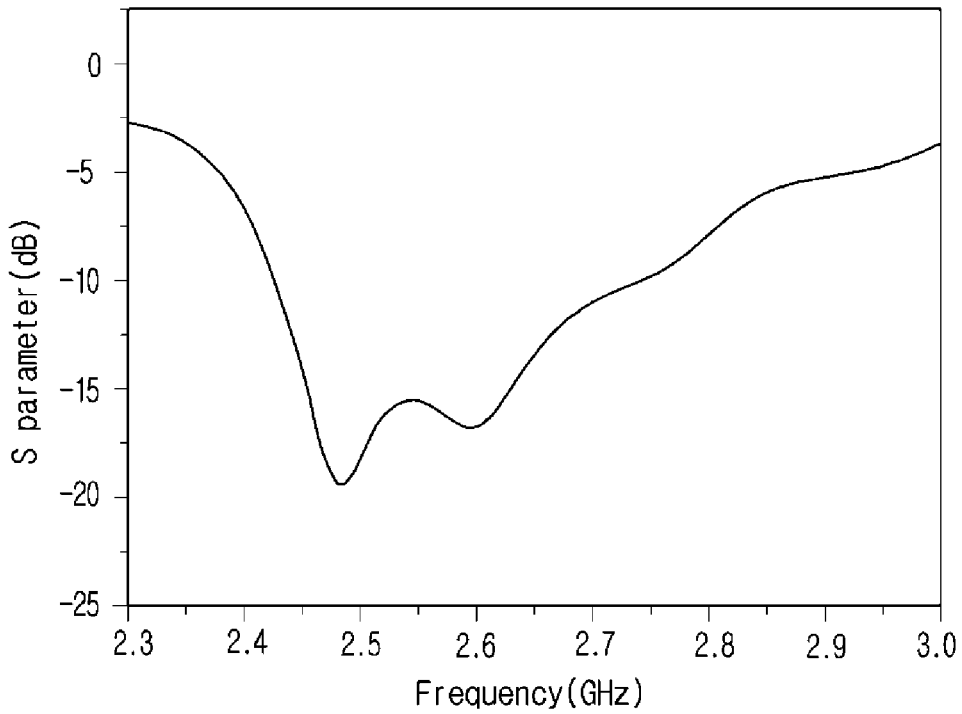
[FIG.7]
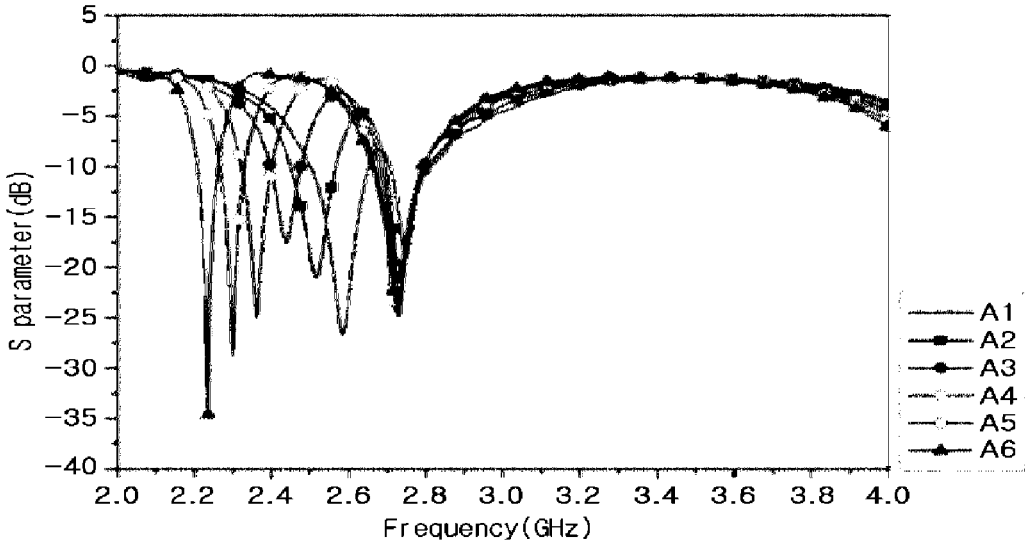

[FIG.8]
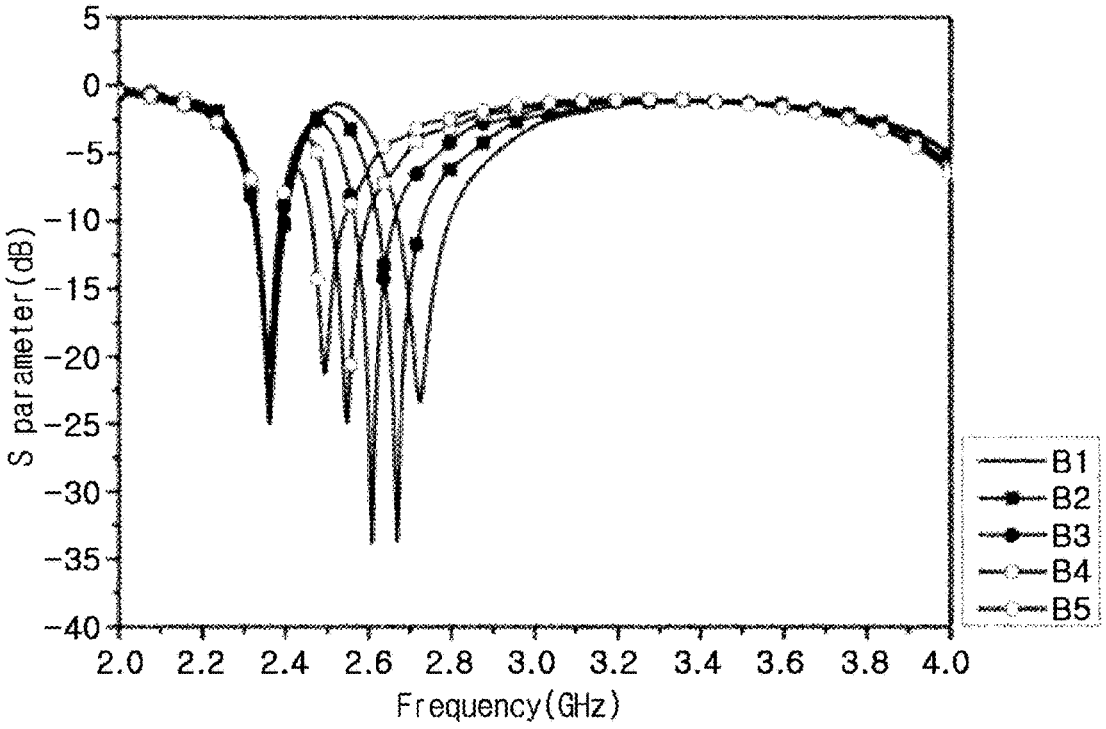

[FIG.9]
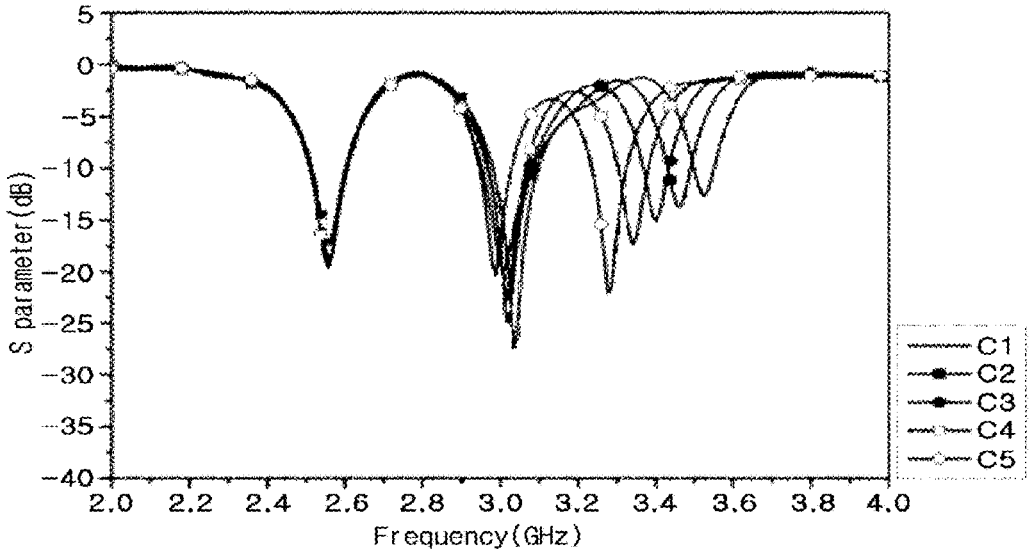

ANTENNA APPARATUS

CROSS-REFERENCE TO RELATED APPLICATIONS

This application is the U.S. national stage application of International Patent Application No. PCT/KR2013/006601, filed Jul. 23, 2013, which claims priority to Korean Application No. 10-2012-0079875, filed Jul. 23, 2012, the disclosures of each of which are incorporated herein by reference in their entirety.

TECHNICAL FIELD

The embodiment relates to an antenna apparatus, and more particularly, to an antenna apparatus of a communication terminal.

BACKGROUND ART

In general, a wireless communication system provides various multi-media services such as a Global Positioning System (GPS), blue-tooth, and Internet. In this case, in order for the wireless communication system to easily provide the multi-media services, a high transmission rate of a large amount of data must be ensured. To this end, researches and studies have been carried out in order to improve the performance of an antenna apparatus in a communication terminal. This is because the antenna apparatus substantially transmits/receives data in the communication terminal. The antenna apparatus may operate at a corresponding resonance frequency band to transmit/receive the data.

However, a resonance frequency band is narrow in the above antenna apparatus. Accordingly, the communication terminal includes a plurality of antenna apparatuses so that the resonance frequency band may be expanded. However, since the communication terminal requires a space for installing the antenna apparatuses, it is difficult to miniaturize the communication terminal. That is, the communication terminal cannot use a relatively wide resonance frequency band through a single antenna apparatus.

DISCLOSURE

Technical Problem

The embodiment provides an antenna apparatus having a relatively wide resonance frequency band. That is, the embodiment expands a resonance frequency band of the antenna apparatus while miniaturizing the antenna apparatus.

Technical Solution

According to the embodiment, there is provided an antenna apparatus including: a lower antenna element; an upper antenna element on the lower antenna element; and an intermediate ground element interposed between the lower antenna element and the upper antenna element and overlapping with the lower antenna element and the upper antenna element.

The antenna apparatus may further include a feeding element connecting the upper antenna element to the lower antenna element, and transferring a signal supplied to the lower antenna element to the upper antenna element.

According to the embodiment, there is provided an antenna apparatus including: a lower plate; a lower antenna element on the lower plate; an intermediate plate laminated on the lower plate and the lower antenna element; an intermediate ground element disposed at the intermediate plate, and overlapping with the lower antenna element while interposing the intermediate plate therebetween as a boundary; an upper plate laminated on the intermediate plate and the intermediate ground element; and an upper antenna element disposed at the upper plate, and overlapping with the intermediate ground element while interposing the upper plate therebetween as a boundary.

The antenna apparatus may further include a feeding element extending by passing through the intermediate plate and the upper plate to connect the upper antenna element with the lower antenna element, and transferring a signal supplied to the lower antenna element to the upper antenna element.

Advantageous Effects

The antenna apparatus according to the embodiment includes the lower antenna element and the upper antenna element so that the antenna apparatus may have an expanded resonance frequency band. Further, since the upper antenna element is laminated on the lower antenna element in the antenna apparatus, the size of the antenna apparatus is not increased. In addition, the intermediate ground element suppresses electromagnetic coupling between the lower antenna element and the upper antenna element in the antenna apparatus, so degradation in performance of the antenna apparatus can be prevented. Accordingly, a communication terminal can use an expanded resonance frequency band through a single antenna apparatus. Therefore, it is not necessary to provide a plurality of antenna apparatuses in a communication terminal so that the communication terminal can be miniaturized.

DESCRIPTION OF DRAWINGS

FIG. 1 is a perspective view showing an antenna apparatus according to the embodiment;

FIG. 2 is an exploded perspective view showing the antenna apparatus according to the embodiment;

FIG. 3 is a perspective view showing an antenna element of the antenna apparatus according to the embodiment;

FIG. 4 is a circuit diagram showing an equivalent circuit of the antenna element according to the embodiment;

FIG. 5 shows plan views illustrating sizes of the antenna apparatus according to the embodiment;

FIG. 6 is a graph illustrating an operation characteristic of the antenna apparatus according to the embodiment; and FIGS. 7, 8 and 9 are graphs illustrating variation in the operation characteristic depending on tuning of the antenna apparatus according to the embodiment.

BEST MODE

Mode for Invention

Hereinafter, the embodiment will be described with reference to accompanying drawings in detail. In the following description, for the illustrative purpose, the same components will be assigned with the same reference numerals, and the repetition in the description about the same components will be omitted in order to avoid redundancy. Detailed descriptions of well-known functions and structures incorporated herein may be omitted to avoid obscuring the subject matter of the present invention.

FIG. 1 is a perspective view showing an antenna apparatus according to the embodiment. FIG. 2 is an exploded perspective view showing the antenna apparatus according to the embodiment. FIG. 3 is a perspective view showing an antenna element of the antenna apparatus according to the embodiment. FIG. 4 is a circuit diagram showing an equivalent circuit of the antenna element according to the embodiment.

Referring to FIGS. 1, 2, and 3, the antenna apparatus 100 of the embodiment includes a drive substrate 110, a ground plate 130, a mounting member 140, and an antenna element 150.

The drive substrate 110 serves as a power feeder and a supporter in the antenna apparatus 100. The drive substrate 110 may include a printed circuit board (PCB). The drive substrate 110 has a flat plate structure. In this case, the drive substrate 110 may be prepared as a single substrate, or may be prepared by laminating a plurality of substrates. Further, a transmission line (not shown) is embedded in the drive substrate 110. The transmission line is connected to an external power supply (not shown) of the antenna apparatus 100 through one end thereof.

In this case, the drive substrate 110 includes a dielectric substance. For example, the drive substrate 110 may include a dielectric substance having conductivity ($\sigma$) of 0.02 and permittivity ($\in$) of 4.6.

The drive substrate 110 includes a bottom surface 111, a top surface 113 corresponding to the lower substrate 111, and a lateral side 115 connecting the top surface 113 to the bottom surface 111. The drive substrate 110 is divided into a ground region 117 and a device region 119. Further, the drive substrate 110 includes a feeding pad 120. The feeding pad 120 is disposed at the device region 119 on the top surface of the drive substrate 110. The feeding pad 120 is connected to an opposite end of the transmission line. That is, when a signal is supplied from an external power supply, power is fed to the feeding pad 120 through the transmission line.

The ground plate 130 of the antenna apparatus 100 is provided for the purpose of grounding. The ground plate 130 has a flat plate structure. Further, the ground plate 130 is disposed at the ground region 117 of the drive substrate 110. In addition, the ground plate 130 is spaced apart from the feeding pad 120 and does not make contact with the feeding pad 120. In this case, the ground plate 130 may be disposed in at least one of the top surface 113 and the bottom surface 111 of the drive substrate 110. The ground plate 130 may cover the ground region 117. When the drive substrate 110 includes a plurality of substrates, the ground plate 130 may be disposed between the substrates.

The mounting member 140 is provided for mounting the antenna element 150 in the antenna apparatus 100. The mounting member 140 has a flat plate structure. The mounting member 140 is disposed at the device region 119 on the top surface of the drive substrate 110. In this case, the mounting member 140 covers the feeding pad 120. Further, the mounting member 140 may protrude from the device region 119 to the ground region 177 on the top surface 133 of the drive substrate 110. In this case, the mounting member 140 may overlap with the ground plate 130.

In this case, the mounting member 140 includes a dielectric substance. The mounting member 140 may include a dielectric substance having the property the same as that of the drive substrate 110, or may include a dielectric substance having a property different from that of the drive substrate 110. Further, the mounting member 140 may include a dielectric substance of a high loss ratio. For example, the mounting member 140 may include a dielectric substance having conductivity of 0.02 and permittivity of 4.6.

In addition, the mounting member 140 includes a bottom plate 141, a lower plate 143, an intermediate plate 145, an upper plate 147, and an outer plate 149. The bottom plate 141, the lower plate 143, the intermediate plate 145, the upper plate 147, and the outer plate 149 have a flat plate structure. Further, the bottom plate 141, the lower plate 143, the intermediate plate 145, the upper plate 147, and the outer plate 149 are sequentially laminated. That is, the lower plate 143 is laminated on the bottom plate 141, the intermediate plate 145 is laminated on the lower plate 143, the upper plate 147 is laminated on the intermediate plate 145, and the outer plate 149 is laminated on the upper plate 147. The bottom plate 141 may adhere to the drive substrate 110.

The bottom plate 141, the lower plate 143, the intermediate plate 145, the upper plate 147, and the outer plate 149 are laminated in one axis direction, for example, a z axis direction. The bottom plate 141, the lower plate 143, the intermediate plate 145, the upper plate 147, and the outer plate 149 may have the same area on a plane, for example, an x-y plane vertical to one axis.

The antenna element 150 is provided to transmit/receive a signal in the antenna apparatus 100. In this case, the antenna element 150 operates at a preset resonance frequency band to transmit/receive an electromagnetic wave. The resonance frequency band of the antenna element 150 may be divided into a low frequency band and a high frequency band. The resonance frequency band may be a multi-frequency band where a low frequency band is separated from a high frequency band based on the frequency. In addition, the resonance frequency band may be a wide frequency band where the low frequency band is coupled with the high frequency band based on the frequency. In addition, the antenna element 150 resonates at preset impedance.

The antenna element 150 is disposed at the device region 119 on the top surface 113 of the drive substrate 110. In this case, the antenna element 150 is connected to the feeding pad 120. The antenna element 150 has a structure branched from the feeding pad 120. In addition, the antenna element 150 may include a metamaterial structure.

The metamaterial signifies an artificially synthesized material or electromagnetic structure that represents specific electromagnetic properties rarely found in nature. The metamaterial has negative conductivity and negative permittivity under the specific condition, and represents an electromagnetic transmission characteristic different from that of a general material or the electromagnetic structure. That is, in the embodiment, a metamaterial structure is adopted to use a characteristic where phase speed of an electromagnetic wave is inverted and the metamaterial structure has a Composite Right/Left Handed (CRLH) structure. The CRLH structure includes a combination of a Right Handed (RH) structure, in which an electric field, a magnetic field, and a propagation direction of an electromagnetic wave represent general characteristics according to the right-handed law, and a Left Handed (LH) structure, in which an electric field, a magnetic field, and a propagation direction of an electromagnetic wave represent characteristics according to the left-handed law opposite to the right-handed law.

Moreover, the antenna element 150 may adhere to the mounting member 140. The antenna element 150 is inserted into the mounting member 140. Further, the antenna element 150 includes a lower antenna element 160, an intermediate ground element 170, an upper antenna element 180, a feeding element 190, a ground via 191, and a feeding via 192.

The lower antenna element 160 transmits/receives a low frequency signal in the resonance frequency band. In this case, the lower antenna element 160 operates at the low frequency band to transmit/receive an electromagnetic wave. The lower antenna element 160 is displayed at the lower plate 143. That is, the lower antenna element 160 is disposed between the lower plate 143 and the intermediate plate 145.

In this case, the lower antenna element 160 may be formed in a patch type and then be attached to the lower plate 143. The lower antenna element 160 may be drawn with a conductive ink so as to be disposed at the lower plate 143. The lower antenna element 160 may be patterned on the lower plate 143. The lower antenna element 160 may include at least one of a bar type antenna element, a meander type antenna element, a spiral type antenna element, a step type antenna element, and a loop type antenna element. In this case, the lower antenna element 160 may include a conductive material. The lower antenna element 160 may include at least one of silver (Ag), palladium (Pd), platinum (Pt), copper (Cu), gold (Au), and nickel (Ni).

In addition, the lower antenna element 160 includes a ground point 161, a lower feeding point 162, and a connection point 163. The ground point 161 is provided to ground the lower antenna element 160. In this case, the ground point 161 is connected to the ground plate 130. The lower feeding point 162 is provided to feed power to the lower antenna element 160. In this case, the lower feeding point 162 is connected to the feeding pad 120. The connecting point 163 is provided for external connection of the antenna element 160. In this case, the connecting point 163 is connected to one end of the feeding element 190. The ground point 161 may be disposed at one end of the lower antenna element 160. In addition, the lower antenna element 160 may extend while sequentially connecting the ground point 161, the lower feeding point 162, and the connecting point 163 with each other. Further, the lower antenna element 160 may be open at an opposite end thereof.

In addition, the lower antenna element 160 includes a lower main element 165 and a lower sub-element 167. The lower main element 165 extends while connecting the ground point 161, the lower feeding point 162, and the connecting point 163 with each other. In this case, the lower main element 165 extends along one route. The lower main element 165 includes one end and an opposite end of the lower antenna element 160. The lower sub-element 167 is connected to the lower main element 165. In this case, the lower sub-element 167 protrudes from the lower main element 165. Further, the lower sub-element 167 extends through a route different from the route of the lower main element 165. In addition, at least one lower slot 169 is formed between the lower main element 165 and the lower sub-element 167.

The intermediate ground element 170 controls electromagnetic coupling between the lower antenna element 160 and the upper antenna element 180. That is, the intermediate ground element 170 suppresses mutual interference according to driving of the lower antenna element 160 and the upper antennal element 180. The intermediate ground element 170 is disposed at the intermediate plate 145. That is, the intermediate ground element 170 is disposed between the intermediate plate 145 and the upper plate 147. In this case, the intermediate ground element 170 is spaced apart from the lower antenna element 160 by the intermediate plate 145. In addition, the intermediate ground element 170 overlaps with the lower antenna element 160 while interposing the intermediate plate 145 therebetween as a boundary.

The upper antenna element 180 transmits/receives a high frequency signal in the resonance frequency band. In this case, the upper antenna element 180 operates at the high frequency band to transmit/receive an electromagnetic wave. The upper antenna element 160 is displayed at the upper plate 147. That is, the upper antenna element 180 is disposed between the upper plate 147 and the outer plate 149. In this case, the upper antenna element 180 is spaced apart from the intermediate ground element 170 by the upper plate 147. Further, the upper antenna element 180 overlaps with the intermediate ground element 170 while interposing the upper plate 147 therebetween as a boundary.

In this case, the upper antenna element 180 may be formed in a patch type and then is attached to the lower plate 143. The upper antenna element 180 may be drawn with a conductive ink so as to be disposed at the upper plate 147. The upper antenna element 180 may be patterned on the upper plate 147. The lower antenna element 160 may include at least one of a bar type antenna element, a meander type antenna element, a spiral type antenna element, a step type antenna element, and a loop type antenna element. In this case, the upper antenna element 160 may include a conductive material. The upper antenna element 180 may include at least one of silver (Ag), palladium (Pd), platinum (Pt), copper (Cu), gold (Au), and nickel (Ni).

Further, the upper antenna element 180 includes an upper feeding point 182. The upper feeding point 182 is provided to feed power to the upper antenna element 180. In this case, the upper feeding point 182 is connected to an opposite end of the feeding element 190. The upper feeding point 182 may be disposed at one end of the upper antenna element 180. Moreover, the upper antenna element 180 may extend from the upper feeding point 182. In addition, an opposite end of the upper antenna element 180 may be open.

Furthermore, the upper antenna element 180 includes an upper main element 185 and an upper sub-element 187. The upper main element 185 includes the upper feeding point 182 and extends along one route. The upper main element 185 includes one end and an opposite end of the upper antenna element 180. The upper sub-element 187 is connected to the upper main element 185. In this case, the upper sub-element 187 protrudes from the upper main element 185. Further, the upper sub-element 187 extends through a route different from the route of the upper main element 185. In addition, at least one upper slot 189 is formed between the upper main element 185 and the upper sub-element 187.

The feeding element 190 transfers a signal from the lower antenna element 160 to the upper antenna element 180. The feeding element 190 passes through the intermediate plate 145 and the upper plate 147. Further, the feeding element 190 is connected to the lower antenna element 160 and the upper antenna element 180. The feeding element 190 connects the upper feeding point 182 of the upper antenna element 180 to the connecting point 163 of the lower antenna element 160. That is, one end of the feeding element 190 makes contact with the connecting point 163, and an opposite end of the feeding element 190 makes contact with the upper feeding point 182. In this case, the feeding element 190 is separated from the intermediate ground element 170 so that the feeding element 190 does not make contact with the intermediate ground element 170. The feeding element 190 may further extend by passing through at least one of the bottom plate 141, the lower plate 143, and the outer plate 149. In this case, the feeding element 190 does not make contact with the ground plate 130.

In this case, the feeding element 190 may be formed by inserting a conductive material into a through hole. The feeding element 190 may include at least one of silver (Ag), palladium (Pd), platinum (Pt), copper (Cu), gold (Au), and nickel (Ni).

The ground via 191 is used to ground the lower antenna element 160. The ground via 191 is formed through the bottom plate 141 and the lower plate 143. Further, the ground via 191 connects the lower antenna element 160 to the ground plate 130. The ground via 191 connects the ground point 161 of the lower antenna element 160 to the ground plate 130. That is, one end of the ground via 191 makes contact with the ground plate 130, and an opposite end of the ground via 191 makes contact with the ground point 161. The ground via 191 may further extend through at least one of the intermediate plate 145, the upper plate 147, and the outer plate 149.

In this case, the ground via 191 may be formed by inserting a conductive material into a through hole. The ground via 191 may include at least one of silver (Ag), palladium (Pd), platinum (Pt), copper (Cu), gold (Au), and nickel (Ni).

The feeding via 192 supplies a signal to the lower antenna element 160. The feeding via 192 is formed through the bottom plate 141 and the lower plate 143. Further, the feeding via 192 connects the lower antenna element 160 to the feeding pad 120 of the drive substrate 110. The feeding via 192 connects the lower feeding point 162 of the lower antenna element 160 to the feeding pad 120. That is, one end of the feeding via 192 makes contact with the feeding pad 120, and an opposite end of the feeding via 192 makes contact with the lower feeding point 162. In this case, the feeding via 192 does not make contact with the ground plate 130. The feeding via 192 may further extend through at least one of the intermediate plate 145, the upper plate 147, and the outer plate 149. In this case, the feeding via 192 is separated from the intermediate ground element 170 so that the feeding via 192 does not make contact with the intermediate feeding element 170.

In this case, the feeding via 192 may be formed by inserting a conductive material into a through hole. The ground via 192 may include at least one of silver (Ag), palladium (Pd), platinum (Pt), copper (Cu), gold (Au), and nickel (Ni).

In the antenna apparatus 100, a signal is supplied from the feeding pad 120 to the antenna element 150. The signal of the feeding pad 120 branches from the antenna element 150 to the lower antenna element 160 and the upper antenna element 180.

That is, the feeding via 192 transfers the signal to the lower antenna element 160. In this case, the feeding via 192 transfers the signal to the lower feeding point 162. Next, the signal is transferred to the lower main element 165 from the lower feeding point 162. Then, the signal is introduced into the lower sub-element 167 from the lower main element 165. Accordingly, the lower antenna element 160 is driven according to the signal. That is, the lower antenna element 160 operates at a low frequency band to transmit/receive an electromagnetic wave.

In addition, the lower antenna element 160 transfers the signal to the upper antenna element 180. In this case, the signal is introduced into the feeding element 190 from the lower main element 165. That is, the signal is transferred to the feeding element 190 from the connecting point 163. Further, the feeding element 190 transfers the signal to the upper antennal element 180. The signal is transferred from the upper feeding point 182 to the upper main element 185. In addition, the signal is introduced from the upper main element 185 into the upper sub-element 187. Accordingly, the lower antenna element 180 is driven according to the signal. That is, the lower antenna element 180 operates at a high frequency band to transmit/receive the electromagnetic wave.

In addition, the antenna apparatus 100 is designed to have predetermined inductance and capacitance to be operated at a resonance frequency band. In this case, the antenna apparatus 100 may be expressed by an equivalent circuit as shown in FIG. 4. That is, the antenna apparatus 100 includes a serial inductor $L_R$, a serial capacitor $C_L$, a parallel capacitor $C_R$, and a parallel inductor $L_L$. The serial inductor $L_R$ is connected with the serial capacitor $C_L$ in series. The parallel capacitor $C_R$ and the parallel inductor $L_L$ are connected with the serial inductor $L_R$ and the serial capacitor $C_L$ in parallel. The serial inductor $L_R$ and the parallel capacitor $C_R$ represent a characteristic of the RH structure, and the serial capacitor $C_L$ and the parallel inductor $L_L$ represent a characteristic of the LH structure.

In this case, the characteristic of the antenna apparatus 100 corresponding to the equivalent circuit is determined according to a structure or a shape of the antenna apparatus 100. For example, a characteristic, such as the serial inductor $L_R$, is determined according to an area, that is, a length and a width of the lower antenna element 160. Further, a characteristic, such as the parallel inductor $L_L$, is determined according to an area, a length and a width of the upper antenna element 180. A characteristic, such as the serial capacitor $C_L$, is determined according to a size of a lower slot 169 in the lower antenna element 160 and a size of an upper slot 189 in the upper antenna element 180. In addition, a characteristic such as the parallel capacitor $C_R$ is determined according to a spacing distance and an overlapping area between the lower antenna element 160 and the intermediate ground element 170, and a spacing distance and an overlapping area between the upper antenna element 180 and the intermediate ground element 170. Moreover, a characteristic, such as the parallel capacitor $C_R$, is determined according to a spacing distance between the lower antenna element 160 and the ground plate 130 and a spacing distance between the upper antenna element 180 and the ground plate 130.

FIG. 5 shows plan views illustrating sizes of the antenna apparatus according to the embodiment. In this case, FIG. 5(*a*) is a plan view illustrating the upper antenna element, FIG. 5(*b*) is a plan view illustrating the intermediate ground element, and FIG. 5(*c*) is a plan view illustrating the lower antenna element.

Referring to FIG. 5, in the antenna apparatus 100 of the embodiment, a mounting member 140 has a rectangular shape. The mounting member 140 may have a width (A_x) of 13.5 mm in an x axis direction, a width (A_y) of 6 mm in a y axis direction, and a thickness (A_h) of 2.2 mm in a z axis direction.

Further, in the upper antenna element 180, the upper main element 185 extends from an upper feeding point 182 in the −y axis direction, −x axis direction, y axis direction, and x axis direction. In addition, the upper sub-element 187 extends in the y axis direction and the −x axis direction from the upper main element 185 extending in the −x axis direction. In this case, at least one upper slot 189 is formed between the upper main element 185 and the upper sub-element 187. Entire parameters in the upper antenna element 180 may be as follows: 1_x1=8.5 mm, 1_x2=3.8 mm, 1_x3=3 mm, 1_y1=5.15 mm, 1_y2=3.6 mm, 1_y3=2 mm, 1_y4=2 mm, 1_g1=0.7 mm, 1_g2=0.2 mm, and 1_w=0.8 mm.

Further, the intermediate ground element 170 has a rectangular flat shape. The entire parameters in the intermediate ground element 170 may be as follows: 2_x1=8.5 mm, and 2_y1=2.5 mm.

In addition, in the lower antenna element 160, the lower main element 165 extends from the ground point 161 in the x axis direction, −y axis direction, −x axis direction, y direction, and x axis direction. Further, the lower sub-element 167 extends in the y axis direction and −x axis direction from the lower main element 165 extending in the −x axis direction. In this case, at least one lower slot 169 is formed between the lower main element 165 and the lower sub-element 167. Entire parameters in the lower antenna element 160 may be as follows: 3_x1=8.5 mm, 3_x2=1.8 mm, 3_x3=3.9 mm, 2_x4=4.5 mm, 3_x5=6.9 mm, 3_y1=5.15 mm, 3_y2=3.9 mm, 3_y3=2.3 mm, 3_y4=2.9 mm, 3_g1=0.2 mm, and 3_sw=1.4 mm.

FIG. 6 is a graph illustrating operation characteristics of the antenna apparatus according to the embodiment. In this case, FIG. 6 illustrates a frequency response characteristic of the antenna apparatus. That is, FIG. 6 illustrates variation of an S parameter according to a frequency band. The S parameter is a factor signifying a voltage ratio between input and output (output voltage/input voltage) at a specific frequency band, and is expressed by a dB scale.

Referring to FIG. 6, the antenna apparatus 100 has a resonance frequency band with an expanded bandwidth. The resonance frequency band represents a frequency band of −5 dB or less. In this case, the resonance frequency band of the antenna apparatus 100 has a bandwidth of approximately 0.54 GHz. The resonance frequency band of the antenna apparatus 100 is in the range of about 2.38 GHz to about 2.92 GHz. Further, the antenna apparatus 100 has relatively high operation efficiency at a frequency band in the range of 2.42 GHz to 2.73 GHz among the resonance frequency band. In this case, the antenna apparatus 100 has operation efficiency of 70% at 2.42 GHz, 58% at 2.48 GHz, 56% at 2.54 GHz, 84% at 2.6 GHz, and 75% at 2.72 GHz.

FIGS. 7, 8 and 9 are graphs illustrating operation characteristics depending on tuning of the antenna apparatus according to the embodiment. In this case, FIGS. 7, 8 and 9 illustrate a frequency response characteristic of the antenna apparatus. That is, FIGS. 7, 8 and 9 illustrate variation of an S parameter according to a frequency band.

That is, in the antenna apparatus 100 of the embodiment, a resonance frequency band may be adjusted by tuning the lower antenna element 160. That is, as shown in FIG. 7, a frequency location of a low frequency band may be changed, and a low frequency bandwidth may be expanded or contracted. In this case, the low frequency may be adjusted in the lower antenna element 160 by adjusting an area of the lower antenna element 160 or a size of the lower slot 169. The low frequency band may be adjusted by adjusting a spacing distance and an overlapping area between the lower antenna element 160 and the intermediate ground element 170. The low frequency band may be adjusted by adjusting a spacing distance between the lower antenna element 160 and the ground plate 130.

In the antenna apparatus 100 of the embodiment, a resonance frequency band may be adjusted by tuning the upper antenna element 180. That is, as shown in FIG. 8, a frequency location of a high frequency band may be changed, and a high frequency bandwidth may be expanded or contracted. As shown in FIG. 9, the high frequency bandwidth may be expanded to at least two. In this case, the high frequency may be adjusted in the upper antenna element 180 by adjusting an area of the upper antenna element 180 or a size of the upper slot 189. The high frequency band may be adjusted by adjusting a spacing distance and an overlapping area between the upper antenna element 180 and the intermediate ground element 170. The high frequency band may be adjusted by adjusting a spacing distance between the upper antenna element 180 and the ground plate 130.

According to the embodiment, the antenna apparatus includes the lower antenna element and the upper antenna element so that the antenna apparatus may have an expanded resonance frequency band. Further, since the lower antenna element is laminated on the lower antenna element in the antenna apparatus, the size of the antenna apparatus is not increased. In addition, the intermediate ground element suppresses electromagnetic coupling between the lower antenna element and the upper antenna element in the antenna apparatus, degradation in performance of the antenna apparatus can be prevented. Accordingly, a communication terminal can use an expanded resonance frequency band through a single antenna apparatus. Therefore, it is not necessary to provide a plurality of antenna apparatuses in the communication terminal so that the communication terminal can be miniaturized.

Although exemplary embodiments of the present invention have been described in detail hereinabove, it should be clearly understood that many variations and modifications of the basic inventive concepts herein taught which may appear to those skilled in the present art will still fall within the spirit and scope of the present invention, as defined in the appended claims.

The invention claimed is:

1. An antenna apparatus comprising:

a lower antenna element formed with a slot;

an upper antenna element formed with a slot and on the lower antenna element;

an intermediate ground element interposed between the lower antenna element and the upper antenna element and overlapping the lower antenna element and the upper antenna element; and a feeding element connecting the upper antenna element to the lower antenna element, and transferring a signal supplied from the lower antenna element to the upper antenna element;

wherein the lower antenna element includes a lower feeding point and a connecting point transferring the signal provided by the lower feeding point;

wherein the feeding element receives the signal provided by the lower feeding point;

wherein the upper antenna element includes an upper feeding point receiving the signal provided by the feeding element;

wherein the lower feeding point and the upper feeding point are connected via the connecting point of the lower antenna element; and wherein the upper antenna element, the intermediate ground element, and the lower antenna element vertically overlap.

2. The antenna apparatus of claim 1, further comprising:

an intermediate plate interposed between the lower antenna element and the intermediate ground element, and spacing the intermediate ground element apart from the lower antenna element; and an upper plate interposed between the intermediate ground element and the upper antenna element, and spacing the intermediate ground element apart from the upper antenna element.

3. The antenna apparatus of claim 2, wherein the feeding element extends by passing through the intermediate plate and the upper plate.

4. The antenna apparatus of claim 2, further comprising a lower plate at which the lower antenna element is disposed and on which the intermediate plate and the upper plate are laminated.

5. The antenna apparatus of claim 4, wherein the lower plate comprises:

a feeding via formed through the lower plate to supply the signal to the lower antenna element; and a ground via formed through the lower plate to ground the lower antenna element.

6. The antenna apparatus of claim 5, further comprising a bottom plate on which the lower plate is laminated, wherein the feeding via and the ground via are formed through the bottom plate.

7. The antenna apparatus of claim 2, further comprising an outer plate laminated on the upper antenna element.

8. The antenna apparatus of claim 1, wherein the lower antenna element comprises:

a lower main element to which the signal is supplied; and a lower sub-element connected to the lower main element, wherein a lower slot is formed between the lower main element and the lower sub-element and is formed vertically overlapping the slot of the upper antenna element.

9. The antenna apparatus of claim 1, wherein the upper antenna element comprises:

an upper main element to which the signal is supplied from the lower antenna element; and an upper sub-element connected to the upper main element, wherein an upper slot is formed between the upper main element and the upper sub-element and is formed vertically overlapping the slot of the lower antenna element.

10. The antenna apparatus of claim 1, further comprising a ground plate making contact with the lower antenna element.

11. The antenna apparatus of claim 10, wherein the lower antenna element comprises a ground point making contact with the ground plate.

12. An antenna apparatus comprising:

a lower plate;

a lower antenna element formed with a slot and on the lower plate;

an intermediate plate laminated on the lower plate and the lower antenna element;

an intermediate ground element disposed at the intermediate plate, and overlapping the lower antenna element while interposing the intermediate plate therebetween as a boundary;

an upper plate laminated on the intermediate plate and the intermediate ground element;

an upper antenna element formed with a slot and disposed at the upper plate, and overlapping the intermediate ground element while interposing the upper plate therebetween as the boundary; and a feeding element extending by passing through the intermediate plate and the upper plate to connect the upper antenna element with the lower antenna element, and transferring a signal supplied by the lower antenna element to the upper antenna element;

wherein the lower antenna element includes a lower feeding point and a connecting point transferring the signal provided by the lower feeding point;

wherein the feeding element receives the signal provided by the lower feeding point;

wherein the upper antenna element includes an upper feeding point receiving the signal from the feeding element;

wherein the lower feeding point and the upper feeding point are connected via the connecting point of the lower antenna element; and wherein the upper antenna element, the intermediate ground element, and the lower antenna element vertically overlap.

13. The antenna apparatus of claim 12, further comprising:

a bottom plate on which the lower plate is laminated;

a feeding via formed through the lower plate and the bottom plate to supply the signal to the lower antenna element; and a ground via formed through the lower plate and the bottom plate to ground the lower antenna element.

* * * * *